US008810467B2

(12) United States Patent
Lee et al.

(10) Patent No.: US 8,810,467 B2
(45) Date of Patent: Aug. 19, 2014

(54) MULTI-BAND DIPOLE ANTENNAS

(75) Inventors: Ting Hee Lee, Penang (MY); Kok Jiunn Ng, Butterworth (MY)

(73) Assignee: Laird Technologies, Inc., Earth City, MO (US)

( * ) Notice: Subject to any disclaimer, the term of this patent is extended or adjusted under 35 U.S.C. 154(b) by 216 days.

(21) Appl. No.: 13/224,730

(22) Filed: Sep. 2, 2011

(65) Prior Publication Data

US 2012/0001818 A1 Jan. 5, 2012

Related U.S. Application Data

(63) Continuation-in-part of application No. PCT/MY2009/000052, filed on Apr. 13, 2009.

(51) Int. Cl.

| | |
|---|---|
| ***H01Q 21/00*** | (2006.01) |
| ***H01Q 19/10*** | (2006.01) |
| ***H01Q 9/14*** | (2006.01) |
| ***H01Q 13/10*** | (2006.01) |
| ***H01Q 9/28*** | (2006.01) |
| ***H01Q 9/16*** | (2006.01) |
| ***H01Q 13/08*** | (2006.01) |
| ***H01Q 1/38*** | (2006.01) |
| ***H01Q 5/00*** | (2006.01) |

(52) U.S. Cl.

CPC ..... *H01Q 13/08* (2013.01); *H01Q 9/145* (2013.01); *H01Q 13/10* (2013.01); *H01Q 9/28* (2013.01); *H01Q 9/16* (2013.01); *H01Q 1/38* (2013.01); *H01Q 5/0062* (2013.01); *H01Q 5/0017* (2013.01); *H01Q 5/00* (2013.01)

USPC ..... 343/817; 343/818

(58) Field of Classification Search

CPC ..... H01Q 9/30; H01Q 9/42; H01Q 5/00; H01Q 5/0003; H01Q 5/0027; H01Q 5/0051; H01Q 5/0055; H01Q 5/0058; H01Q 5/0062; H01Q 5/0068

USPC ..... 343/817, 818, 702, 793, 833, 794, 803, 343/806, 810, 815

See application file for complete search history.

(56) References Cited

U.S. PATENT DOCUMENTS 5,182,570 A * 1/1993 Nysen et al. ..... 343/795
5,949,383 A * 9/1999 Hayes et al. ..... 343/795

(Continued)

FOREIGN PATENT DOCUMENTS

CN 101414705 2/2006
CN 101208825 6/2008

(Continued)

OTHER PUBLICATIONS

Written Opinion and International Search Report issued by the International Search Authority dated Dec. 30, 2009 for International Patent Application No. PCT/MY2009/000052 which is the parent application to the instant continuation-in-part application, 12 pages.

(Continued)

*Primary Examiner* — Hoang V Nguyen
*Assistant Examiner* — Patrick Holecek
(74) *Attorney, Agent, or Firm* — Harness, Dickey & Pierce, P.L.C.

(57) ABSTRACT

Multi-band dipole antennas for wireless application devices are disclosed. An example antenna includes at least one dipole including a resonant element and a ground element. A feed point is coupled to the resonant element, and a ground point is coupled to the ground element. The example antenna also includes a parasitic element adjacent at least a portion of the resonant element. The parasitic element is coupled to the ground element and configured to be operable for changing a resonant frequency of at least a portion of the resonant element.

25 Claims, 14 Drawing Sheets

(56) References Cited

U.S. PATENT DOCUMENTS

| | | | | |
|---|---|---|---|---|
| 6,337,667 | B1 * | 1/2002 | Ayala et al. | 343/795 |
| 6,975,278 | B2 * | 12/2005 | Song et al. | 343/833 |
| 7,315,289 | B2 * | 1/2008 | Puente Baliarda et al. | 343/817 |
| 2003/0231139 | A1 | 12/2003 | Tai et al. | |
| 2004/0222936 | A1 | 11/2004 | Hung et al. | |
| 2004/0257291 | A1 * | 12/2004 | Man et al. | 343/818 |
| 2005/0001777 | A1 | 1/2005 | Suganthan et al. | |
| 2005/0195119 | A1 | 9/2005 | Gaucher et al. | |
| 2006/0033666 | A1 | 2/2006 | Su et al. | |

FOREIGN PATENT DOCUMENTS

| | | |
|---|---|---|
| TW | I200425578 | 11/2004 |
| WO | WO2007000483 | 1/2007 |
| WO | WO 2007/094402 | 8/2007 |
| WO | WO 2010/120164 | 10/2010 |

OTHER PUBLICATIONS

Chinese office action dated Aug. 1, 2013 for co-pending Chinese application No. 200980158668.6 (published as CN102396109 on Mar. 28, 2012) which claims priority to the same parent application PCT International Application No. PCT/MY2009/000052 (published as WO 2010/120164) as the instant application; 10 pgs.

Taiwan Office Action dated Sep. 2, 2013 from TW application No. 099110509 filed Apr. 6, 2010 (now Publication No. TW201042834, published Dec. 1, 2010) which claims priority to the same parent PCT Application No. PCT/MY2009/000052 filed Apr. 13, 2009) (now Publication No. WO 2010/120164 published Oct. 21, 2010; 11 pages.

* cited by examiner

| FREQUENCY [MHz] | EFFICIENCY [%] | EFFICIENCY [dB] | TOTAL PEAK GAIN [dBi] |
|---|---|---|---|
| 824(MHz) | 64% | -1.93 | 2.87 |
| 836(MHz) | 61% | -2.12 | 3.42 |
| 849(MHz) | 56% | -2.51 | 2.99 |
| 868(MHz) | 56% | -2.52 | 2.68 |
| 880(MHz) | 50% | -2.97 | 2.47 |
| 894(MHz) | 49% | -3.13 | 3.10 |
| 900(MHz) | 57% | -2.46 | 3.72 |
| 915(MHz) | 54% | -2.64 | 2.96 |
| 925(MHz) | 54% | -2.68 | 2.26 |
| 940(MHz) | 48% | -3.16 | 1.83 |
| 960(MHz) | 47% | -3.25 | 1.97 |
| 1575(MHz) | 40% | -3.93 | 2.13 |
| 1672(MHz) | 67% | -1.73 | 4.37 |
| 1710(MHz) | 64% | -1.97 | 2.90 |
| 1750(MHz) | 59% | -2.31 | 2.94 |
| 1785(MHz) | 63% | -2.04 | 2.67 |
| 1805(MHz) | 67% | -1.75 | 2.45 |
| 1840(MHz) | 68% | -1.66 | 2.97 |
| 1850(MHz) | 70% | -1.58 | 3.24 |
| 1880(MHz) | 72% | -1.44 | 3.96 |
| 1910(MHz) | 72% | -1.42 | 3.73 |
| 1920(MHz) | 73% | -1.38 | 3.63 |
| 1930(MHz) | 76% | -1.21 | 3.73 |
| 1950(MHz) | 74% | -1.30 | 3.82 |
| 1960(MHz) | 72% | -1.45 | 3.73 |
| 1980(MHz) | 71% | -1.48 | 4.02 |
| 1990(MHz) | 74% | -1.29 | 4.37 |
| 2110(MHz) | 66% | -1.81 | 3.56 |
| 2140(MHz) | 70% | -1.57 | 3.95 |
| 2170(MHz) | 66% | -1.80 | 4.00 |

FIG.9

MULTI-BAND DIPOLE ANTENNAS

CROSS REFERENCE TO RELATED APPLICATION

This application is a continuation-in-part of PCT International Patent Application No. PCT/MY2009/000052 filed Apr. 13, 2009 (published as WO 2010/120164). The entire disclosure of the above application is incorporated herein by reference.

FIELD

The present disclosure generally relates to multi-band antennas for use with wireless application devices.

BACKGROUND

This section provides background information related to the present disclosure which is not necessarily prior art.

Wireless application devices, such as laptop computers, cellular phones, etc. are commonly used in wireless operations. And, such use is continuously increasing. Consequently, additional frequency bands are required to accommodate the increased use, and antennas capable of handling the additional different frequency bands are desired.

FIG. 1 illustrates a conventional half-wave dipole antenna 100. The antenna 100 includes a radiator element 102 and a ground element 104. The radiator element 102 and the ground element 104 are connected to, and fed by, a signal feed 106. Each of the radiator element 102 and the ground element 104 has a length of about one quarter of the wavelength (¼λ) of a desired resonant frequency of the antenna. Together the radiator element 102 and the ground element 104 have a combined length of about one half of the wavelength (½λ) 108 of the desired resonant frequency of the antenna.

In order to create a dipole antenna that will radiate in more than one frequency band, one or more additional radiators are sometimes added or tapped to a radiator element of a dipole antenna. Additionally, to reduce the size of the dipole antenna, dipole antenna elements (both radiator elements and ground elements) are sometimes folded, turned, meandered, etc. FIG. 2 illustrates a conventional multi-band folded dipole antenna 200. The antenna 200 includes a first radiator element 202 and a second radiator element 204. Collectively, the first radiator element 202 and the second radiator element 204 form a radiator 205. The antenna 200 also includes a first ground element 206 and a second ground element 208, which collectively form a ground 209. A signal is fed to the antenna through a coaxial cable 210 coupled to the ground 209 and the radiator 205.

SUMMARY

This section provides a general summary of the disclosure, and is not a comprehensive disclosure of its full scope or all of its features.

According to various aspects, example embodiments are provided of antennas configured to be installed to wireless application devices. In one example embodiment, a multi-band dipole antenna includes at least one dipole including a resonant element and a ground element, a feed point coupled to the resonant element, and a ground point coupled to the ground element. A parasitic element is adjacent at least a portion of the resonant element. The parasitic element is coupled to the ground element and configured to be operable for changing a resonant frequency of at least a portion of the resonant element.

In another example embodiment, a multi-band dipole antenna includes a resonant element substantially in a single plane and a ground element in the plane. The resonant element includes a first arm and a second arm. The first arm is connected to the second arm. A parasitic element is positioned in the plane alongside at least a portion of the first arm. The parasitic element is electrically connected to the ground element and capacitively coupled to the first arm so as to be operable for changing a resonant frequency of at least a portion of the resonant element.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 4:
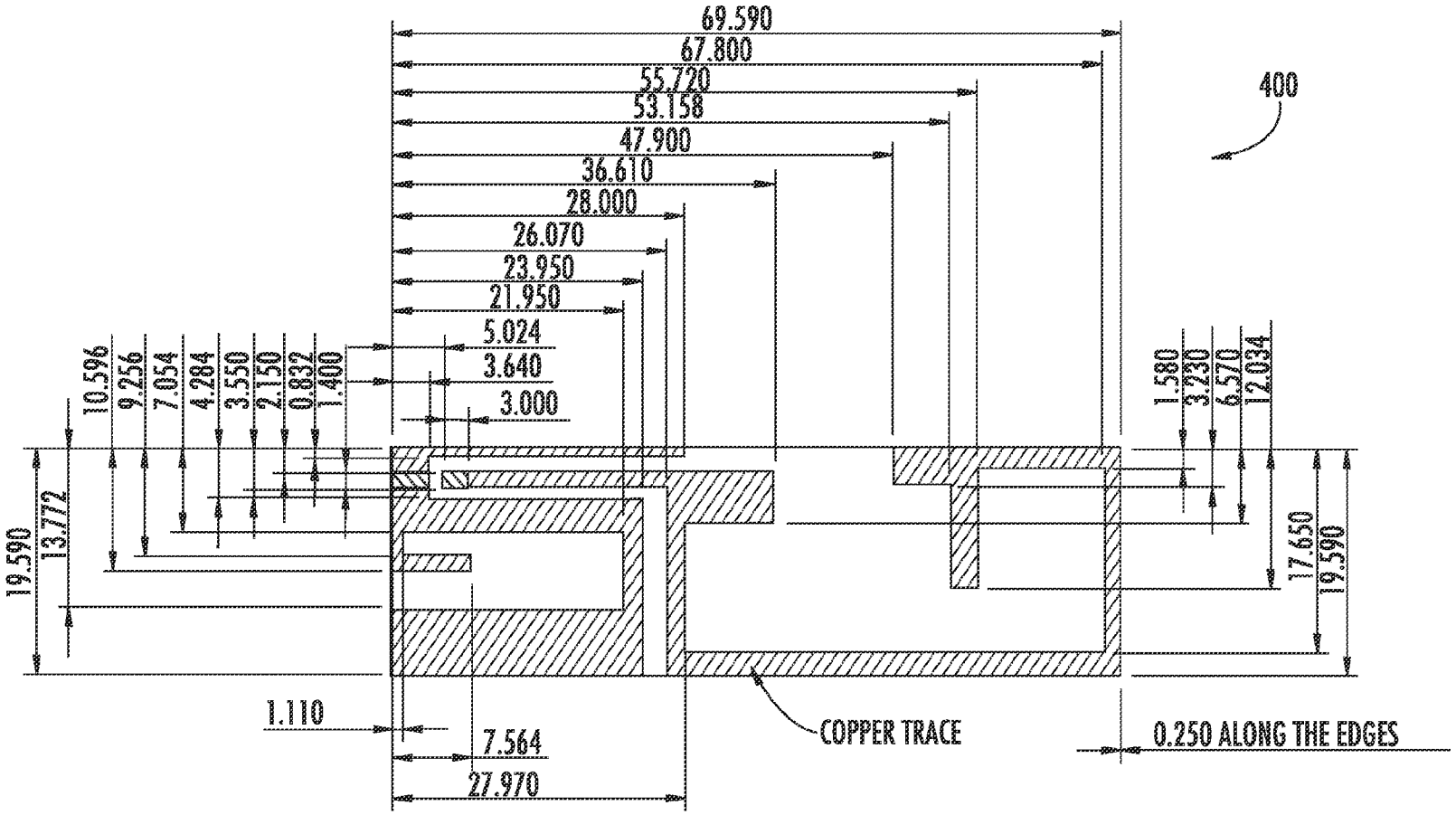
FIG. 4 is a top plan view of an example embodiment of an antenna including one or more aspects of the present disclosure with exemplary dimensions provided for purposes of illustration only according to exemplary embodiments.
Figure 6:
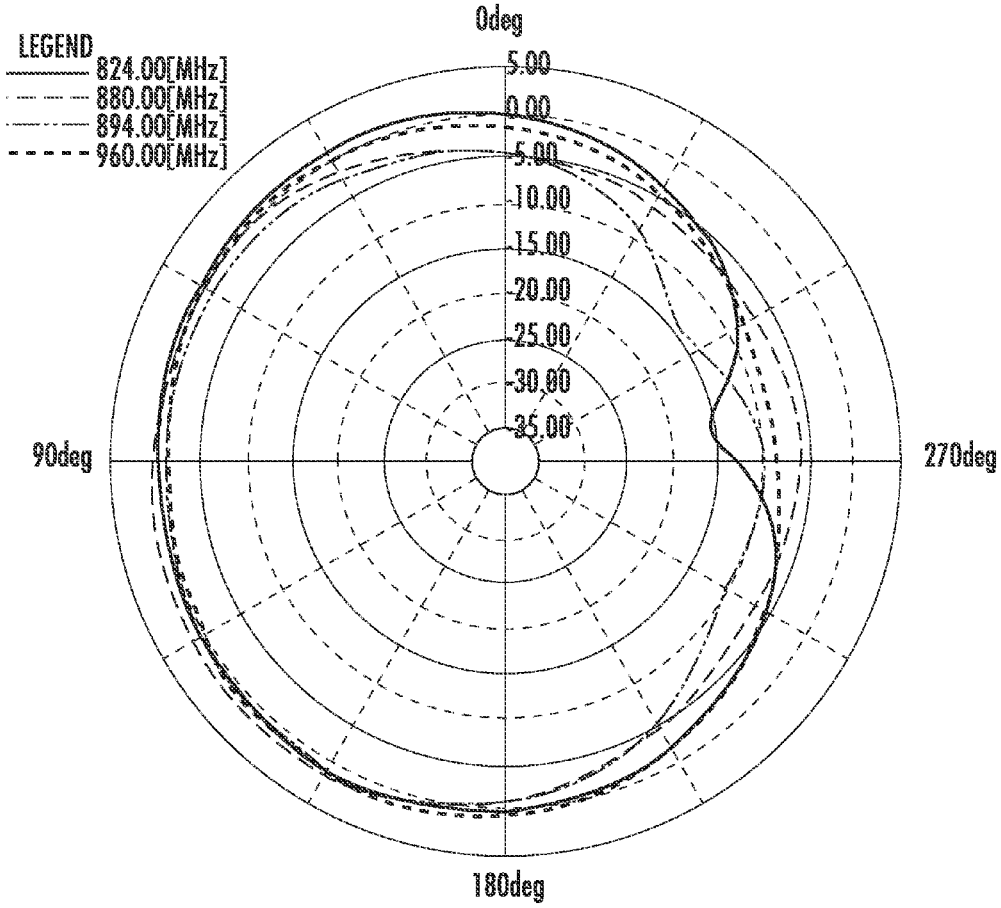
Figure 7A:
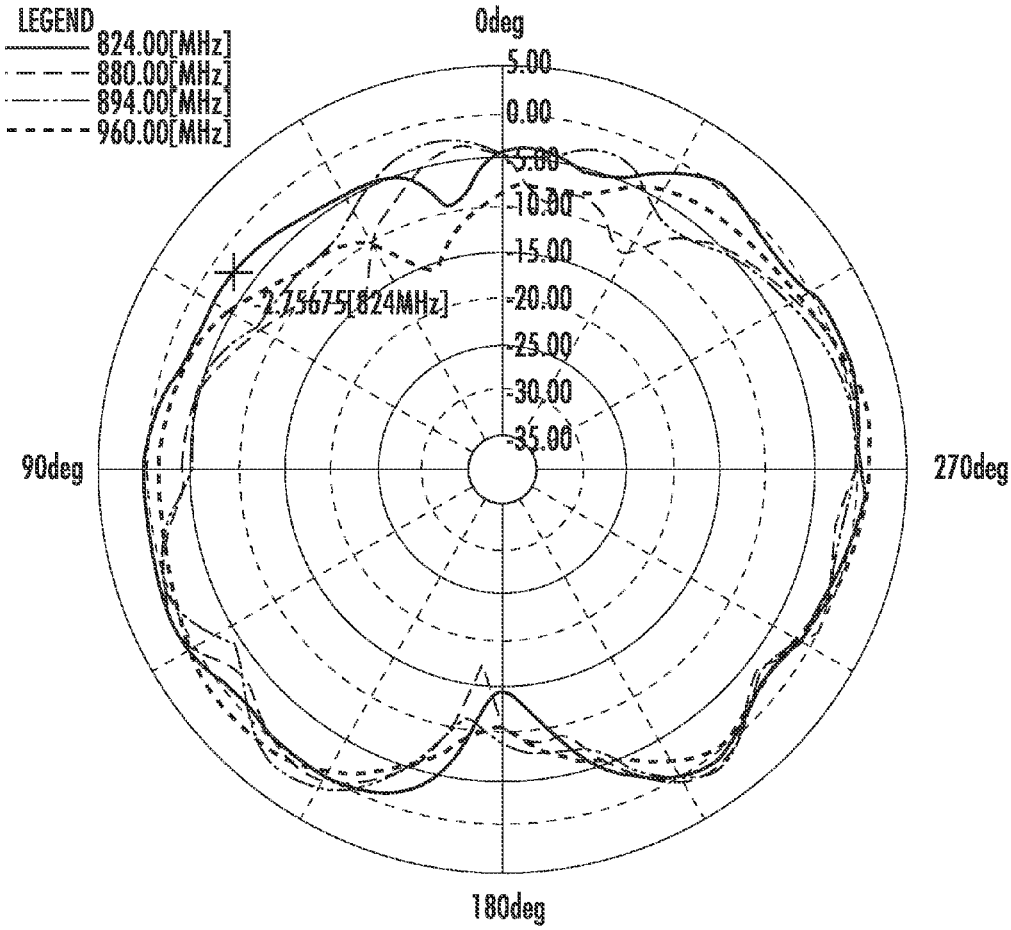
Figure 7B:
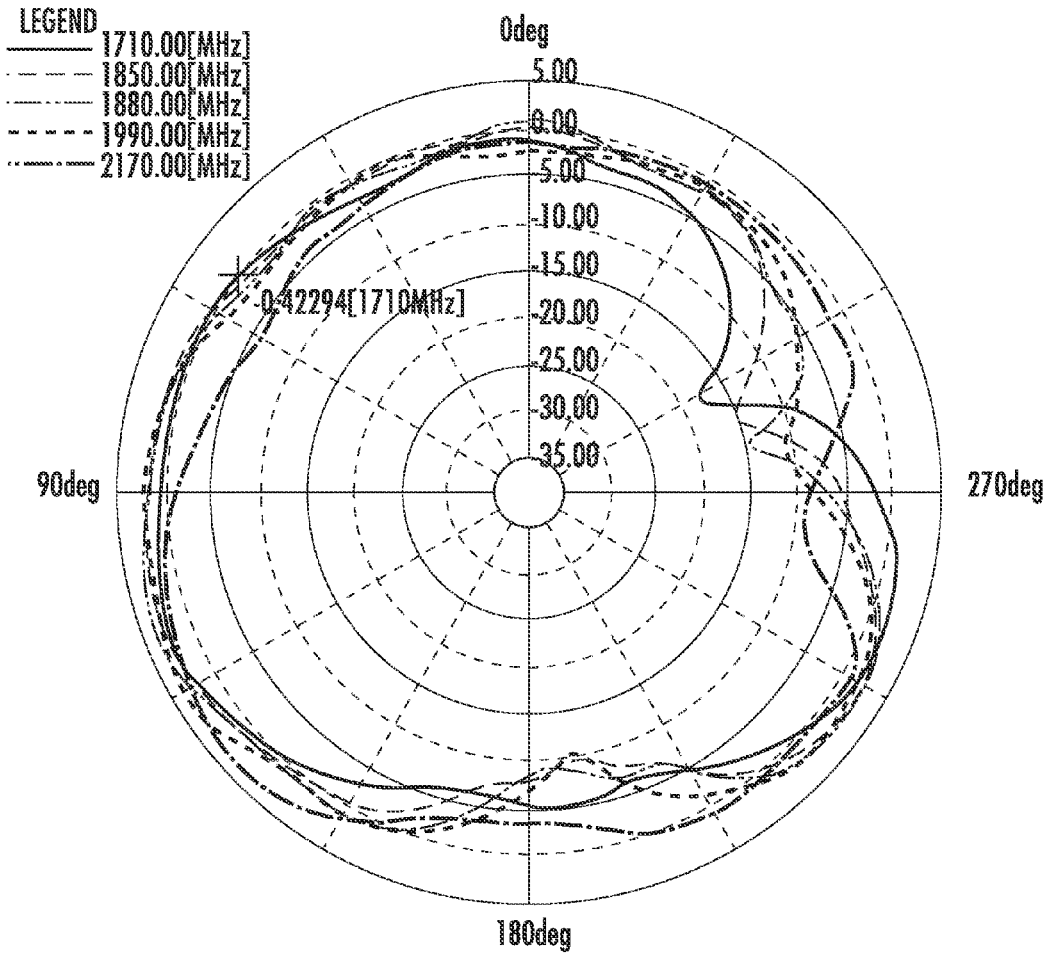
Figure 8A:
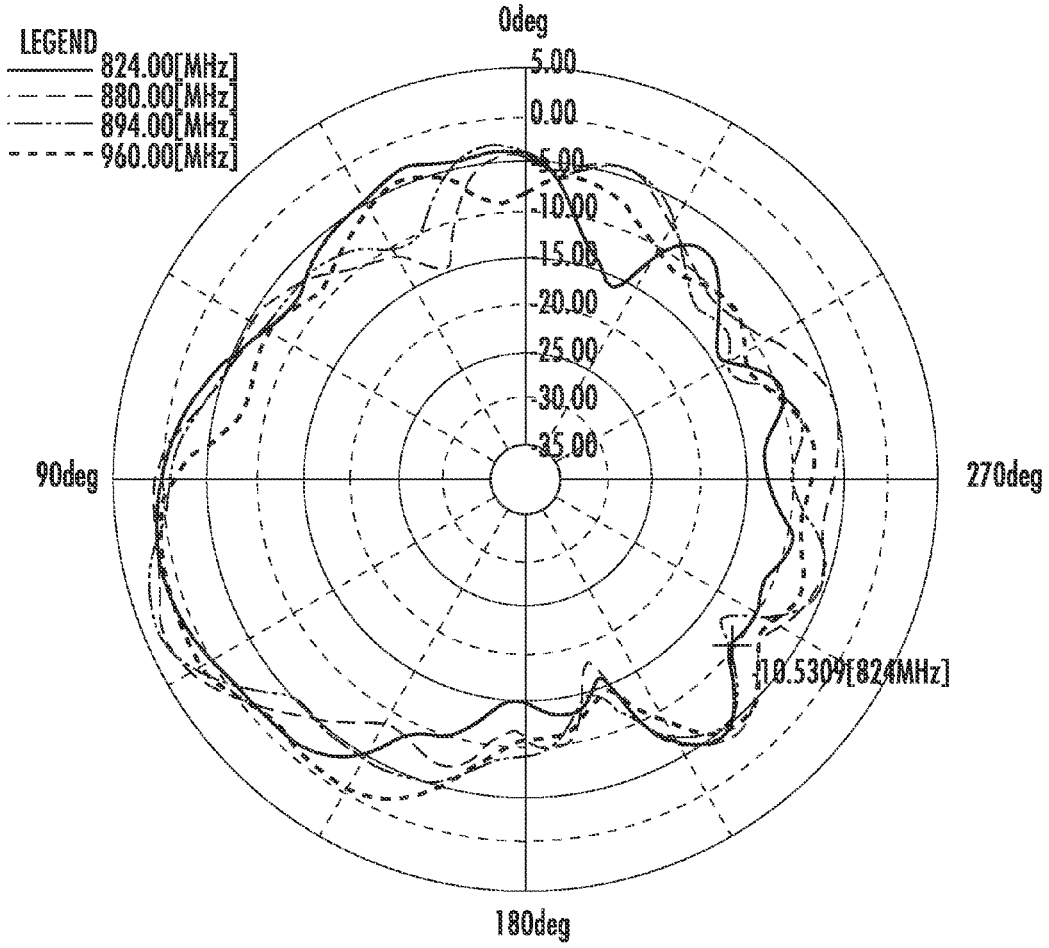
Figure 8B:
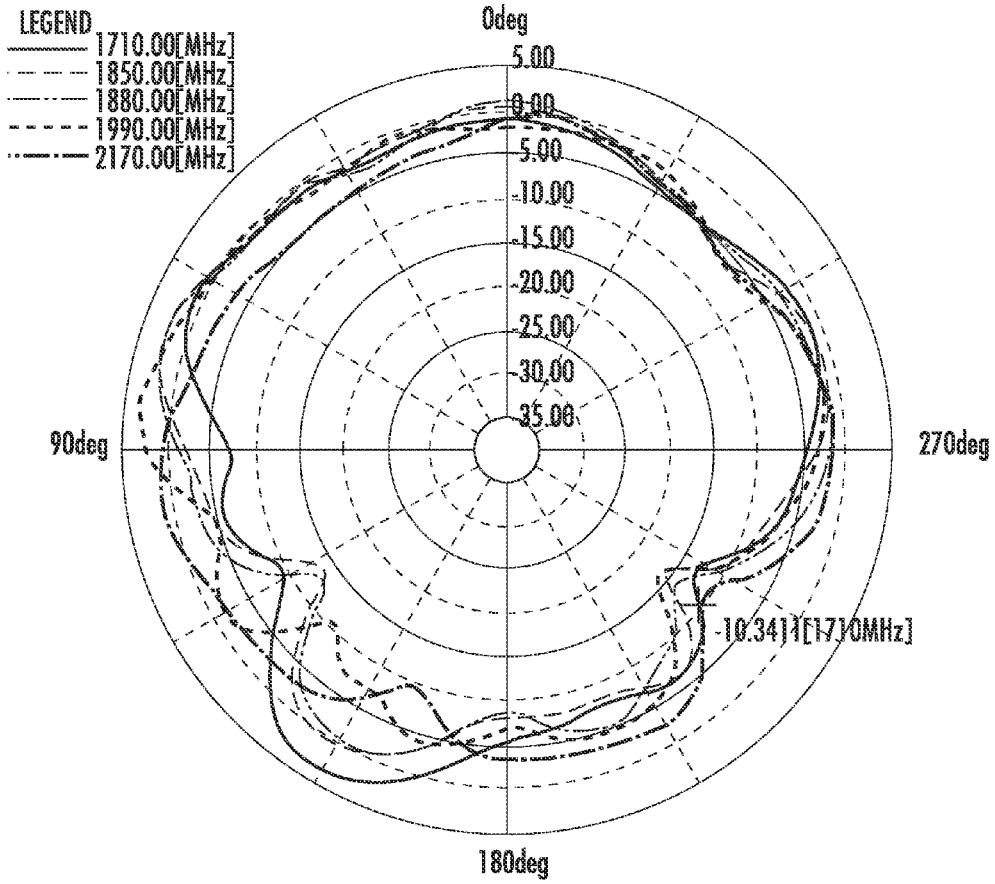
Figure 10:
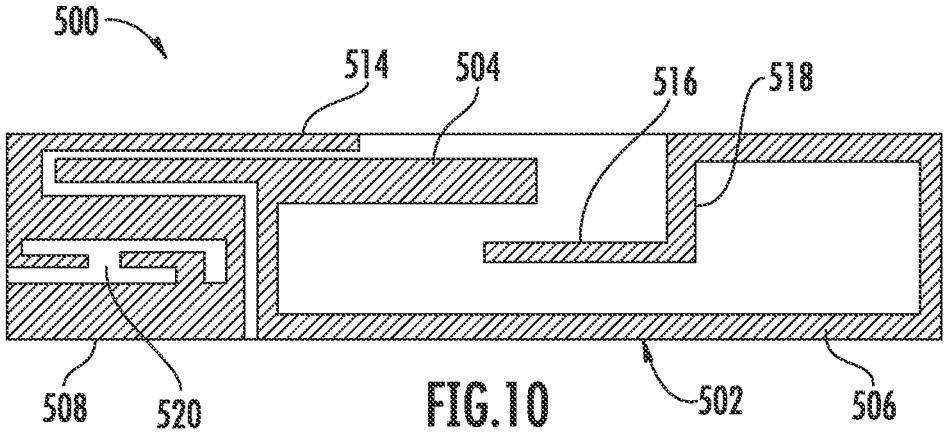
Figure 11:
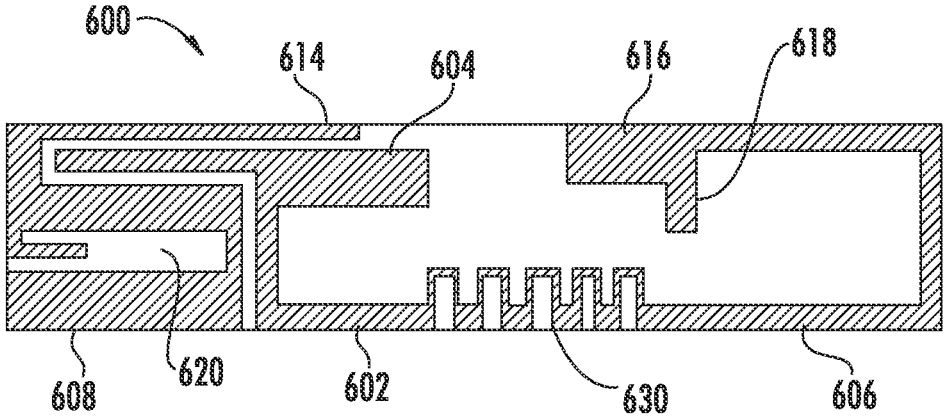
Figure 12:
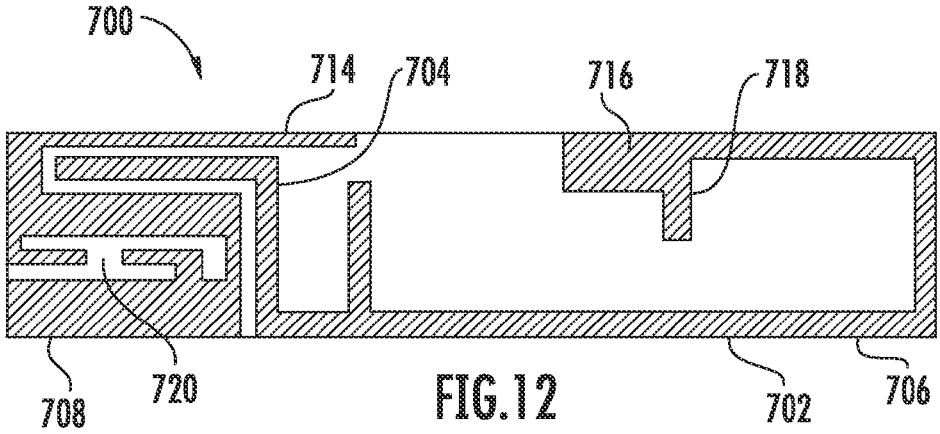
Figure 13:
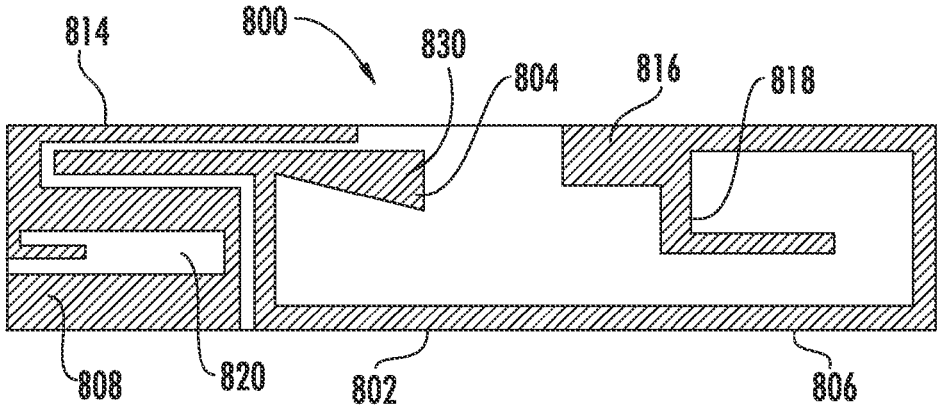
Figure 14:
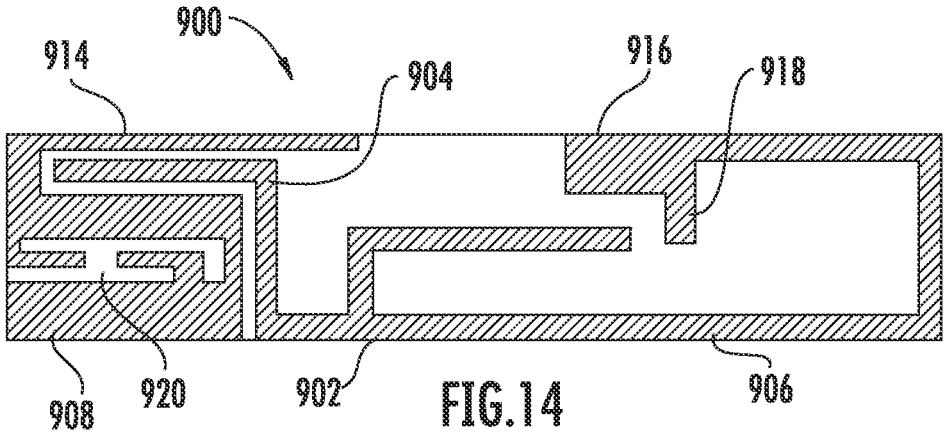

FIG. 6 illustrates azimuth radiation patterns for the example antenna of FIG. 4 for frequencies of about 824 Megahertz, about 880 Megahertz, about 894 Megahertz, and about 960 Megahertz;

FIG. 7A illustrates zero degree elevation radiation patterns for the example antenna of FIG. 4 for frequencies of about 824 Megahertz, about 880 Megahertz, about 894 Megahertz, and about 960 Megahertz;

FIG. 7B illustrates zero degree elevation radiation patterns for the example antenna of FIG. 4 for frequencies of about 1710 Megahertz, about 1850 Megahertz, about 1990 Megahertz, and about 2170 Megahertz;

FIG. 8A illustrates ninety degree elevation radiation patterns for the example antenna of FIG. 4 for frequencies of about 824 Megahertz, about 880 Megahertz, about 894 Megahertz, and about 960 Megahertz;

FIG. 8B illustrates ninety degree elevation radiation patterns for the example antenna of FIG. 4 for frequencies of about 1710 Megahertz, about 1850 Megahertz, about 1990 Megahertz, and about 2170 Megahertz;

FIG. 9 is a table of the efficiency (as a percentage and in decibels) and total peak gain (in decibels referenced to isotropic gain (dBi)) for the example antenna of FIG. 4 for various frequencies from about 824 Megahertz to about 2170 Megahertz;

FIG. 10 is a top plan view of another example embodiment of an antenna including one or more aspects of the present disclosure;

FIG. 11 is a top plan view of another example embodiment of an antenna including one or more aspects of the present disclosure;

FIG. 12 is a top plan view of another example embodiment of an antenna including one or more aspects of the present disclosure;

FIG. 13 is a top plan view of another example embodiment of an antenna including one or more aspects of the present disclosure; and FIG. 14 is a top plan view of another example embodiment of an antenna including one or more aspects of the present disclosure.

DETAILED DESCRIPTION

Example embodiments will now be described more fully with reference to the accompanying drawings.

Figure 1:
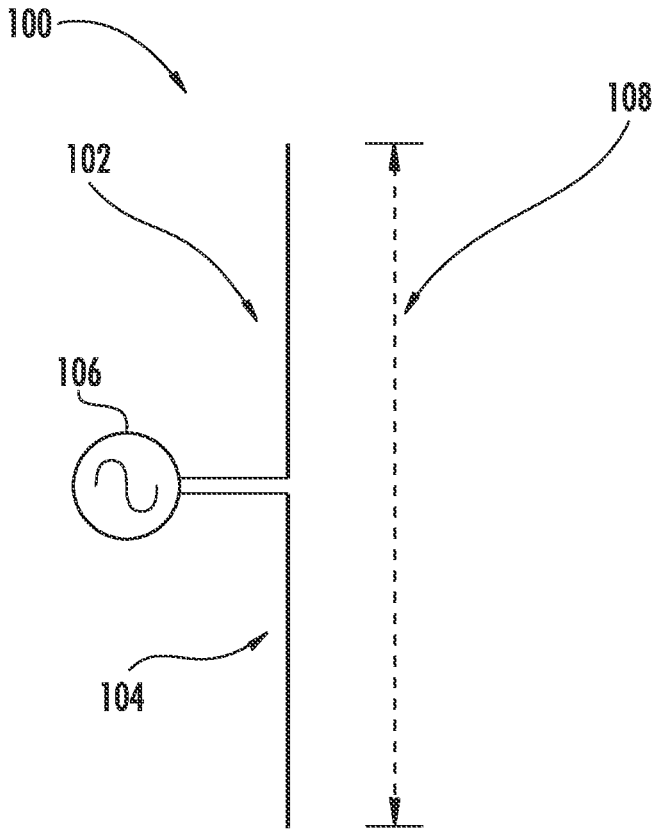
FIG. 1 is a conventional dipole antenna.
Figure 2:
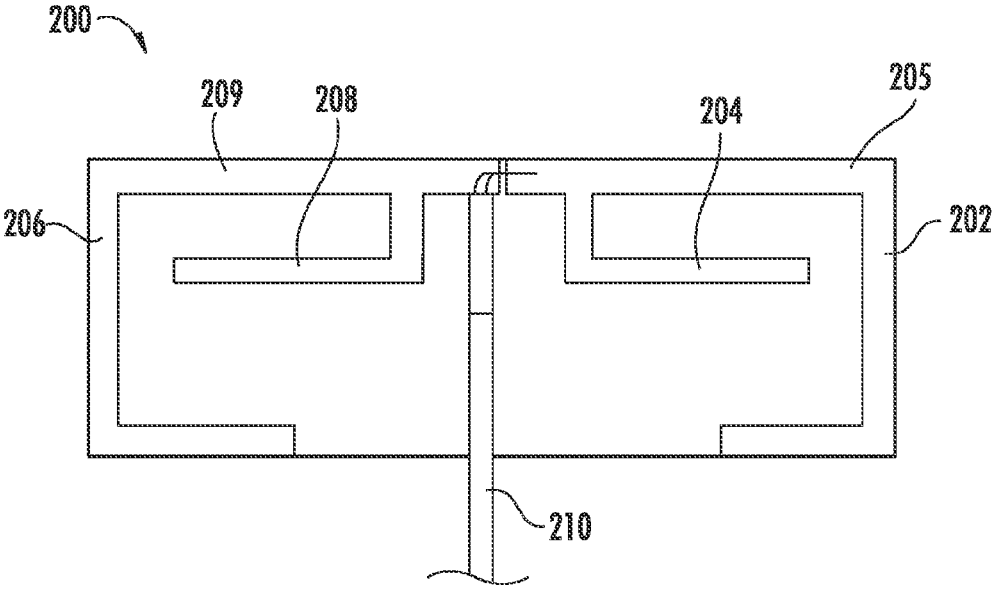
FIG. 2 PRIOR ART
FIG. 2 is a top plan view illustrating a conventional multi-band folded dipole antenna in which a coaxial cable is coupled to the ground and radiator of the antenna.
Figure 3A:
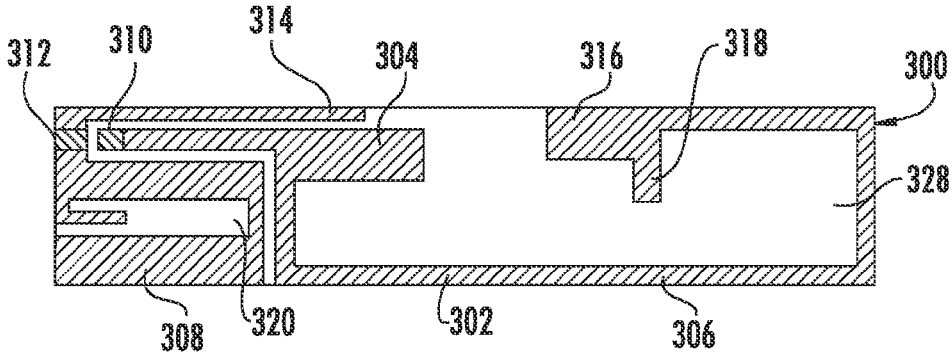
FIG. 3A is a top plan view of an example embodiment of a multiband half-wave dipole antenna including one or more aspects of the present disclosure.
Figure 3B:
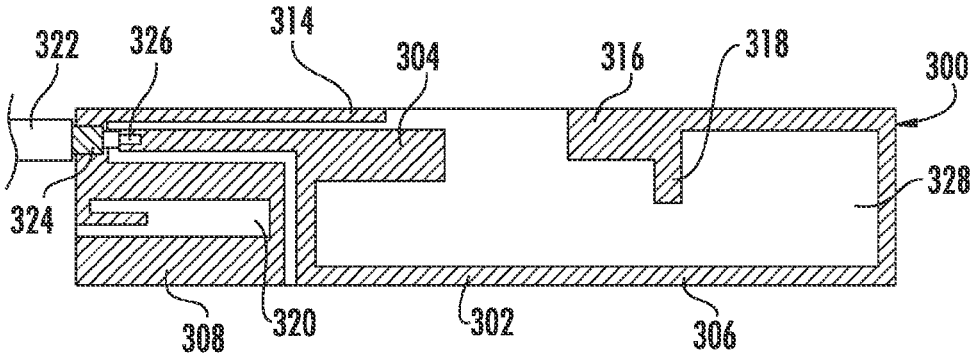
FIG. 3B is a top plan view of the antenna in FIG. 3A connected to a signal cable according to an exemplary embodiment.

FIGS. 3A and 3B illustrate an example embodiment of an antenna generally at reference number 300 including one or more aspects of the present disclosure. The illustrated antenna 300 may be integrated in, embedded in, installed to, etc. a wireless application device (not shown), including, for example, a personal computer, a cellular phone, personal digital assistant (PDA), etc. within the scope of the present disclosure.

As shown in FIG. 3, the illustrated antenna 300 is a multi-band half-wave dipole antenna. The antenna 300 includes resonant element 302 having first and second arms 304 and 306. The resonant element 302 forms at least one dipole with a ground element 308. The antenna 300 includes a feed point 310 coupled to the resonant element 302 and a ground point 312 coupled to the ground element 308. The antenna 300 also includes a parasitic element 314 positioned adjacent the first arm 304.

The first arm 304 and the second arm 306 are quarter wavelength (¼λ) radiating arms. Each arm 304, 306 is sized to be approximately one quarter of the wavelength of a desired resonant frequency of the antenna 300. In this embodiment, the first arm 304 is a high frequency radiator and the second arm 306 is a low frequency radiator. Accordingly, the first arm 304 is shorter than the second arm 306. To help minimize or at least reduce the overall size of the antenna 300, the second arm 306 is folded, bent, or turned so as to include the two upper and lower horizontal sections connected to a vertical straight section (on the far right side) as illustrated in FIG. 3A. Antennas according to the present disclosure are not limited, however, to antennas with folded elements. As will be understood by those skilled in the art, although designed to have a primary resonance at some frequency, the first arm 304 will resonate across a first frequency range and the second arm 306 will resonate across a second frequency range. The first and second frequency ranges each have a bandwidth from the lowest to highest frequency in its frequency range. According to some exemplary embodiments, the first arm 304 (in conjunction with parasitic element 314 as described below) is resonant over a frequency range from about 824 Megahertz to about 960 Megahertz, and the second arm 306 is resonant over a frequency range from about 1710 Megahertz to about 2170 Megahertz.

The parasitic element 314 is coupled to the ground element 308 and positioned adjacent to a portion of the resonant element 302. Capacitive coupling between the parasitic element 314 and the resonant element 302 changes the resonant frequency of a portion of the resonant element 302. In this particular embodiment, the parasitic element 314 is positioned adjacent the first arm 304. The capacitive coupling between the parasitic element 314 and the first arm 304 changes the resonant frequency of the first arm 304 and increases the bandwidth covered by the first arm 304.

The second arm 306 includes a first tuning element 316 and a second tuning element 318. These two tuning elements 316, 318 excite additional resonant frequencies to combine with resonant frequency of the rest of the second arm 306. This excitation of additional frequencies increases the bandwidth of the frequency range of the second arm 306.

The ground element 308 permits the antenna 300 to be ground independent. Accordingly, the antenna 300 does not depend on a separate ground element or ground plane. The ground element 308 includes a slot 320. This slot 320 increases the electrical length of the ground element 308. By increasing the electrical length of the ground element 308, the resonant frequencies of the antenna 300, and especially the second arm 306, are shifted to lower frequencies.

As shown in FIG. 3B, the antenna 300 may be fed by a signal cable 322 (such as, for example, coaxial cable, etc.). A ground portion 324 of cable 322 is connected to the ground point 312. A signal portion 326 of cable 322 is connected to the feed point 310. The cable 322 may be connected to the ground point 312 and the feed point 310 by any suitable means, such as by soldering, welding, etc. The location of the feed point 310 and ground point 312 permits flexibility in routing of the signal cable 322. The other end (not illustrated) of the cable 322 may be terminated with any suitable connector for connecting the antenna 300 to a receiver/transmitter of a wireless application device. Suitable connectors include, for example, U.FL, SMA, MMCX, etc.

In some embodiments, the antenna 300 includes, and/or is supported by, a substrate, such as substrate 328. The substrate 328 may be a rigid insulator, such as a circuit board substrate (e.g., Flame Retardant 4 or FR4, etc.), plastic carrier, etc. Alternatively, the substrate 328 may be a flexible insulator, such as a flexible circuit board, flex-film, etc. The antenna 300 may be, or may be part of, a printed circuit board (whether rigid or flexible), where the resonant element 302, feed point 310, ground point 312, and parasitic element 314 are all conductive traces on the circuit board substrate. The antenna 300 can be a single sided PCB antenna. Alternatively, the antenna 300 (whether mounted on a substrate or not) may be constructed from sheet metal by cutting, stamping, etching, etc.

The antenna 300 may be an internal antenna integrated in or mounted on a wireless application device. The antenna 300 may be mounted to a wireless application device (whether inside or outside the device housing) by means of double sided foam tape or screws. If mounted with screws, holes (not shown) may be drilled through the antenna 300 (preferably through the substrate 328). The antenna 300 may also be used as an external antenna. The antenna 300 may be mounted in its own housing, and the cable 322 may be terminated with a connector for connecting to an external antenna connector of a wireless application device. Such embodiments permit the antenna 300 to be used with any suitable wireless application device without needing to be designed to fit inside the wireless application device housing.

FIG. 4 illustrates an exemplary embodiment of an antenna 400 according to one or more aspects of the present disclosure including dimensions in millimeters for purposes of illustration only and not for purposes of limitation. In the particular embodiment shown in FIG. 4, the substrate of the antenna 400 may comprise single sided 0.8 millimeter thick FR4 with 1 ounce per square foot copper. The elements of the antenna 400 may comprise copper traces plated with immersion tin over immersion nickel. The materials and dimensions provided herein are for purposes of illustration only as an antenna may be configured from different materials and/or with different dimensions depending, for example, on the particular frequency ranges desired, presence or absence of a substrate, the dielectric constant of any substrate, space considerations, etc.

Figure 5:
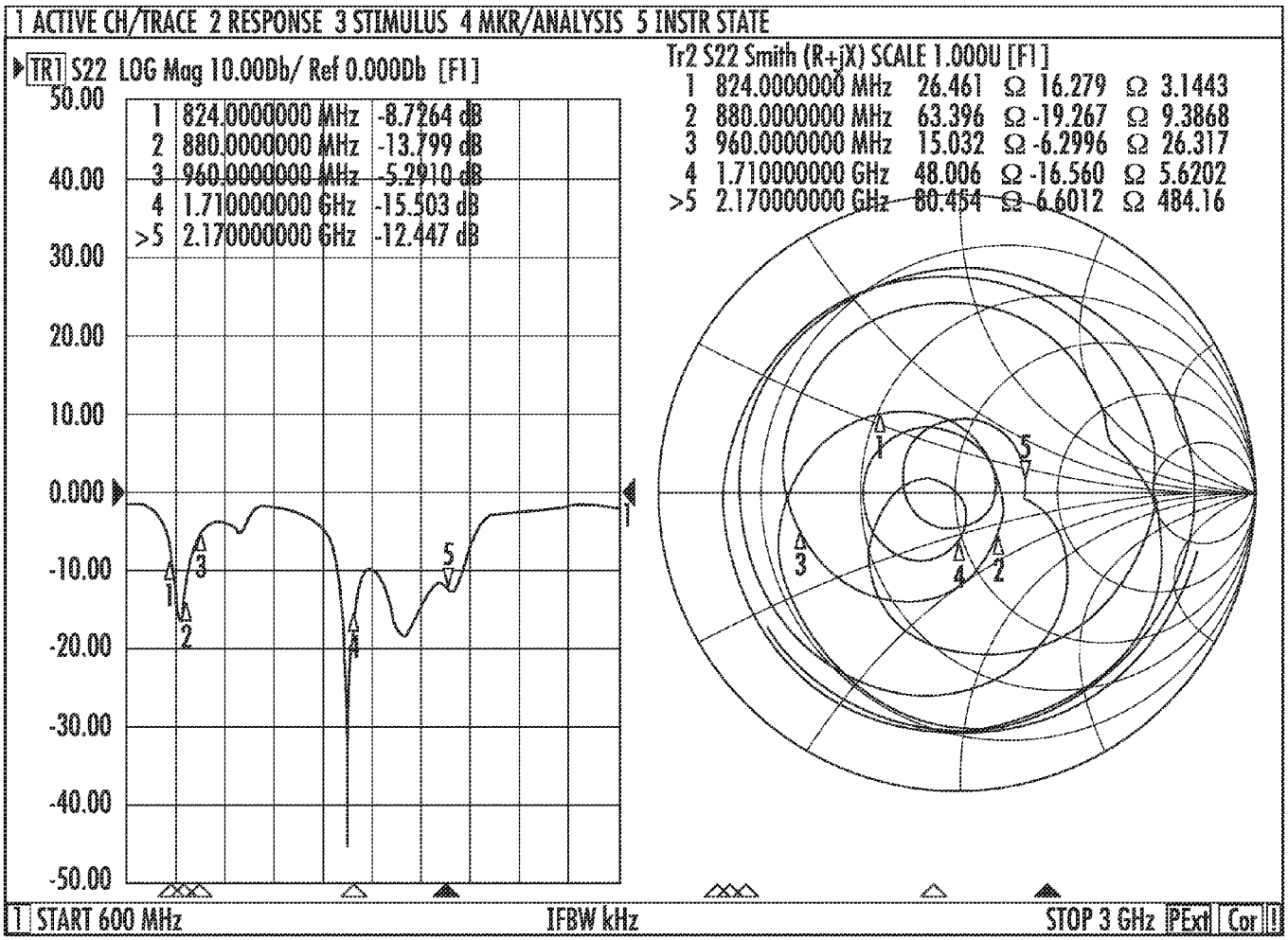
FIG. 5 is a line graph illustrating return loss in decibels for the example antenna of FIG. 4 over a frequency bandwidth of about 600 Megahertz to about 3000 megahertz and a Smith chart for the antenna of FIG. 4 over a frequency bandwidth of about 600 Megahertz to about 3000 Megahertz.

FIGS. 5 through 9 illustrate analysis results for the antenna 400 in FIG. 4. FIG. 5 illustrates a graph of the S22 return loss and a Smith chart of the antenna 400 over a frequency bandwidth of 600 Megahertz to 3 Gigahertz frequencies. FIG. 6 illustrates the ninety degree azimuth radiation patterns of the antenna 400 for frequencies of about 824 Megahertz, about 880 Megahertz, about 894 Megahertz, and about 960 Megahertz. FIG. 7A illustrates the zero degree elevation radiation patterns of the antenna 400 for frequencies of about 824 Megahertz, about 880 Megahertz, about 894 Megahertz, and about 960 Megahertz. FIG. 7B illustrates the zero degree elevation radiation patterns of the antenna 400 for frequencies of about 1710 Megahertz, about 1850 Megahertz, about 1990 Megahertz, and about 2170 Megahertz. FIG. 8A illustrates the ninety degree elevation radiation patterns of the antenna 400 for frequencies of about 824 Megahertz, about 880 Megahertz, about 894 Megahertz, and about 960 Megahertz. FIG. 8B illustrates the ninety degree elevation radiation patterns of the antenna 400 for frequencies of about 1710 Megahertz, about 1850 Megahertz, about 1990 Megahertz, and about 2170 Megahertz. FIG. 9 is a table of the efficiency and total peak gain for the antenna 400 at numerous frequencies from about 824 Megahertz to about 2170 Megahertz. The performance of the antenna 400 as shown in FIGS. 5 through 9 demonstrates that the antenna 400 may be suitable at least for GSM 850, GSM 900, GSM 1800, GSM 1900, IMT-2000/UMTS and GPS wireless application devices.

FIGS. 10 through 14 illustrate several other exemplary embodiments of antennas 500, 600, 700, 800, 900 according to one or more aspects of the present disclosure. All of the antennas 500, 600, 700, 800, 900 are similar to the antennas 300, 400 discussed above, but with some differences in the shape of the arms of the resonant elements and/or the slots in the ground elements. For example, FIG. 11 illustrates the antenna 600 that includes a meander section 630 in its lower frequency or second arm 606, while antenna 800, in FIG. 13, has a substantially triangular shaped portion 830 in its higher frequency or first arm 804.

With continued reference to FIGS. 10 through 14, each of the illustrated antennas 500, 600, 700, 800, 900 include a resonant element 502, 602, 702, 802, 902 having a first arm 504, 604, 704, 804, 904 and a second arm 506, 606, 706, 806, 906. The resonant element 502, 602, 702, 802, 902 forms at least one dipole with a ground element 508, 608, 708, 808, 908. A parasitic element 514, 614, 714, 814, 914 is positioned adjacent the first arm 504, 604, 704, 804, 904. The second arm 506, 606, 706, 806, 906 includes a first tuning element 516, 616, 716, 816, 916 and a second tuning element 518, 618, 718, 818, 918. The ground element 508, 608, 708, 808, 908 includes a slot 520, 620, 720, 820, 920. Similar to FIG. 3A, each antenna 500, 600, 700, 800, 900 may also include a feed point coupled to the resonant element as well as a ground point coupled to the ground element.

As is evident by the various configurations of the illustrated antennas 300, 400, 500, 600, 700, 800, 900, antennas according to the present disclosure may be varied without departing from the scope of this disclosure and the specific configurations disclosed herein are exemplary embodiments only and are not intended to limit this disclosure. For example, as shown by a comparison of FIG. 3 with FIGS. 10 through 14, the size, shape, length, width, inclusion, etc. of the arms, tuning elements, and/or slots may be varied. Additionally, or alternatively, the size and shape of the parasitic element and its distance from the first arm may be varied. As will be understood by one of ordinary skill, one or more of such changes may be made to adapt an antenna to different frequency ranges, the different dielectric constants of any substrate (or the lack of any substrate), to increase the bandwidth of one or more resonant arms, enhance one or more other features, etc.

Numerical dimensions and values are provided herein for illustrative purposes only. The particular dimensions and values provided are not intended to limit the scope of the present disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A multi-band dipole antenna comprising:

at least one dipole including a resonant element and a ground element, the ground element including a non-conductive slot, the resonant element including a first arm resonant in at least a first frequency range and a second arm resonant in at least a second frequency range, the first arm connected to the second arm and including at least a portion which is not part of the second arm, the first arm having a substantially rectangular shape and not including a meander section;

a feed point coupled to the resonant element;

a ground point coupled to the ground element; and a substantially rectangular parasitic element extending from the ground point and adjacent at least a portion of the resonant element, the parasitic element coupled to the ground element, the parasitic element configured to be operable for changing a resonant frequency of at least a portion of the resonant element.

2. The antenna of claim 1, wherein one long side of the parasitic element is parallel and adjacent one long side of the first arm.

3. The antenna of claim 1, wherein:

the parasitic element is coupled to the ground element with the ground point disposed between the parasitic element and the ground element; and the parasitic element is capacitively coupled to the first arm.

4. The antenna of claim 1, wherein the second arm includes a first tuning element to increase a bandwidth of the second frequency range.

5. The antenna of claim 4, wherein the second arm includes a second tuning element to increase the bandwidth of the second frequency range.

6. The antenna of claim 1, wherein the first and second arms are configured to be operable as quarter wavelength (¼λ) radiating arms such that:

at the first frequency range, the first arm has an electrical length of about λ/4; and at the second frequency range, the second arm has an electrical length of about λ/4.

7. The antenna of claim 1, wherein:

the second arm includes a meander section.

8. The antenna of claim 1, wherein:

the first frequency range has a first center frequency, the second frequency range has a second center frequency, and the first center frequency is greater than the second center frequency; and the first and second frequency ranges do not overlap; and the first frequency range is about 1710 Megahertz to 2170 Megahertz; and the second frequency range is about 824 Megahertz to 960 Megahertz.

9. The antenna of claim 1, wherein the nonconductive slot is configured to increase an electrical length of the antenna.

10. The antenna of claim 1, further comprising a substrate supporting the dipole, the feed point, the ground point, and the parasitic element, and wherein the feedpoint is located at an end of the substrate.

11. The antenna of claim 10, wherein:

the dipole, the feed point, the ground point, and the parasitic element comprise conductive traces on the substrate; and the substrate is a rigid insulator or a flexible insulator.

12. The antenna of claim 1, wherein:

the antenna is constructed from sheet metal; or the antenna is constructed from a rigid conductive material; or the antenna comprises traces on a printed circuit board.

13. A portable communications device including the antenna of claim 1.

14. A multi-band dipole antenna comprising:

at least one dipole including a resonant element and a ground element, the resonant element including a first arm resonant in at least a first frequency range and a second arm resonant in at least a second frequency range, the first arm including at least a portion which is not part of the second arm, the second arm including a first tuning element to increase a bandwidth of the second frequency range;

a feed point coupled to the resonant element;

a ground point coupled to the ground element; and a substantially rectangular parasitic element adjacent at least a portion of the resonant element, the parasitic element coupled to the ground element, the parasitic element configured to be operable for changing a resonant frequency of at least a portion of the resonant element, wherein the feed point is disposed between a long axis of the ground element and a long axis of the parasitic element for end feeding the multi-band dipole antenna.

15. A multi-band dipole antenna comprising:

a resonant element substantially in a single plane, the resonant element including a first arm resonant in at least a first frequency range and a second arm resonant in at least a second frequency range, the first arm connected to the second arm and including at least a portion which is not part of the second arm, the first arm having a substantially rectangular shape and not including a meander section;

a ground element in the plane, the ground element configured to permit the antenna to be ground independent such that the antenna does not depend on a separate ground element or ground plane;

a substantially rectangular parasitic element positioned in the plane alongside at least a portion of the first arm, the parasitic element electrically connected to the ground element, the parasitic element capacitively coupled to the first arm so as to be operable for changing a resonant frequency of at least a portion of the resonant element.

16. The antenna of claim 15, wherein the second arm includes a first tuning element for increasing a bandwidth of the second frequency range.

17. The antenna of claim 16, wherein the second arm includes a second tuning element for increasing a bandwidth of the second frequency range.

18. The antenna of claim 15, wherein the ground element includes a nonconductive slot that is configured to increase an electrical length of the antenna.

19. The antenna of claim 15, wherein:

the second arm includes a meander section; and one long side of the parasitic element is parallel and adjacent one long side of a first arm of the resonant element, and the parasitic element is capacitively coupled to the first arm.

20. The antenna of claim 15, wherein:

the antenna comprises traces on a printed circuit board;

the antenna is constructed from sheet metal; or the antenna is constructed from a rigid conductive material.

21. The antenna of claim 15, further comprising a substrate supporting the dipole, the feed point, the ground point, and the parasitic element, and wherein the feedpoint is located at an end of the substrate.

22. The antenna of claim 21, wherein:

the dipole, the feed point, the ground point and the parasitic element comprise conductive traces on the substrate; and the substrate is a rigid insulator or a flexible insulator.

23. The antenna of claim 15, wherein:

the first arm is resonant in a first frequency range, and the second arm is resonant in a second frequency range; and the first and second frequency ranges do not overlap; and the first frequency range is about 1710 Megahertz to 2170 Megahertz; and the second frequency range is about 824 Megahertz to 960 Megahertz.

24. A portable communications device including the antenna of claim 15.

25. A multi-band dipole antenna comprising:

a resonant element substantially in a single plane, the resonant element including a first arm and a second arm, the first arm connected to the second arm and including at least a portion which is not part of the second arm, the first arm resonant in a first frequency range, the second arm resonant in a second frequency range, the second arm including a first tuning element for increasing a bandwidth of the second frequency range;

a feed point coupled to the resonant element;

a ground element in the plane; and a substantially rectangular parasitic element positioned in the plane alongside at least a portion of the first arm, the parasitic element electrically connected to the ground element, the parasitic element capacitively coupled to the first arm so as to be operable for changing a resonant frequency of at least a portion of the resonant element, wherein a long axis of the parasitic element is substantially in parallel with a long axis of the ground element, and the feed point is disposed between the long axis of the ground element and the long axis of the parasitic element for end feeding the multi-band dipole antenna.

* * * * *